US009004981B2

(12) United States Patent
Fries

(10) Patent No.: US 9,004,981 B2
(45) Date of Patent: Apr. 14, 2015

(54) APPARATUS FOR DOUBLE-SIDED, GRINDING MACHINING OF FLAT WORKPIECES

(75) Inventor: Adrian Fries, Rendsburg (DE)

(73) Assignee: Peter Wolters GmbH, Rendsburg (DE)

( * ) Notice: Subject to any disclaimer, the term of this patent is extended or adjusted under 35 U.S.C. 154(b) by 418 days.

(21) Appl. No.: 13/141,126

(22) PCT Filed: Nov. 18, 2009

(86) PCT No.: PCT/EP2009/008184
§ 371 (c)(1),
(2), (4) Date: Aug. 10, 2011

(87) PCT Pub. No.: WO2010/072289
PCT Pub. Date: Jul. 1, 2010

(65) Prior Publication Data

US 2011/0300785 A1 Dec. 8, 2011

(30) Foreign Application Priority Data

Dec. 22, 2008 (DE) ..... 10 2008 063 228

(51) Int. Cl.

| | |
|---|---|
| ***B24B 7/00*** | (2006.01) |
| ***B24B 7/17*** | (2006.01) |
| ***B24B 7/22*** | (2006.01) |
| ***B24B 9/00*** | (2006.01) |
| ***B24B 29/00*** | (2006.01) |
| ***B24B 37/08*** | (2012.01) |
| ***B24D 13/14*** | (2006.01) |

(52) U.S. Cl.
CPC . *B24B 7/17* (2013.01); *B24B 7/228* (2013.01); *B24B 9/00* (2013.01); *B24B 29/005* (2013.01); *B24B 37/08* (2013.01); *B24D 13/145* (2013.01)

(58) Field of Classification Search
CPC ..... B24B 7/17; B24B 7/228; B24B 13/145; B24B 29/005; B24B 37/08; B24B 9/00
USPC ..... 451/36, 41, 57, 262, 261, 270, 271, 267
See application file for complete search history.

(56) References Cited

U.S. PATENT DOCUMENTS

| | | | | |
|---|---|---|---|---|
| 1,763,820 A | | 6/1930 | Rodemeyer | |
| 5,121,572 A | * | 6/1992 | Hilscher | 451/269 |
| 5,584,898 A | * | 12/1996 | Fulton | 51/309 |

(Continued)

FOREIGN PATENT DOCUMENTS

| | | |
|---|---|---|
| CN | 1953840 A | 4/2007 |
| DE | 33 35 116 A1 | 3/1984 |

(Continued)

*Primary Examiner* — Lee D Wilson
*Assistant Examiner* — Joel Crandall
(74) *Attorney, Agent, or Firm* — Vidas, Arrett & Steinkraus, P.A.

(57) ABSTRACT

The invention relates to an apparatus for the double-sided, grinding machining of flat workpieces with an upper and a lower work disk, each of which has a work surface with a grinding layer, wherein the work surfaces form a work gap amongst themselves, in which workpieces can be ground, wherein at least one of the work disks is rotatably drivable by means of a driving mechanism, and further having a device for guiding the workpieces in the work gap. It is provided according to the invention that debarring means are arranged on at least one of the work disks, which are designed to deburr the workpieces during their machining in the apparatus.

12 Claims, 4 Drawing Sheets

(56) References Cited

U.S. PATENT DOCUMENTS

| | | | | | |
|---|---|---|---|---|---|
| 5,778,481 | A * | 7/1998 | Amsden et al. | 15/230.16 |
| 5,846,122 | A * | 12/1998 | Graebner et al. | 451/28 |
| 5,902,173 | A * | 5/1999 | Tanaka | 451/56 |
| 5,934,983 | A * | 8/1999 | Wada et al. | 451/63 |
| 5,944,591 | A * | 8/1999 | Chen | 451/290 |
| 6,080,042 | A * | 6/2000 | McGregor et al. | 451/41 |
| 6,142,859 | A * | 11/2000 | Ross et al. | 451/443 |
| 6,146,244 | A * | 11/2000 | Atsugi et al. | 451/36 |
| 6,210,259 | B1 * | 4/2001 | Malkin et al. | 451/166 |
| 6,254,461 | B1 * | 7/2001 | Benning et al. | 451/56 |
| 6,261,156 | B1 * | 7/2001 | Johnson et al. | 451/41 |
| 6,379,230 | B1 * | 4/2002 | Hayashi et al. | 451/292 |
| 6,439,965 | B1 * | 8/2002 | Ichino et al. | 451/36 |
| 6,485,357 | B1 * | 11/2002 | Divine | 451/58 |
| 6,793,837 | B2 * | 9/2004 | Wenski et al. | 216/88 |
| 6,811,469 | B2 * | 11/2004 | Yamamoto et al. | 451/41 |
| 6,841,057 | B2 * | 1/2005 | Wadensweiler et al. | 205/672 |
| 6,986,703 | B2 * | 1/2006 | Weber | 451/285 |
| 7,008,308 | B2 * | 3/2006 | Bjelopavlic et al. | 451/269 |
| 7,354,337 | B2 * | 4/2008 | Fujita | 451/443 |
| 7,500,905 | B2 * | 3/2009 | Iga | 451/57 |
| 7,775,858 | B2 * | 8/2010 | Weber | 451/261 |
| 2002/0028640 | A1 * | 3/2002 | Barnhart et al. | 451/41 |
| 2003/0087593 | A1 * | 5/2003 | Van Der Sluis | 451/260 |
| 2005/0272348 | A1 * | 12/2005 | Min et al. | 451/11 |

FOREIGN PATENT DOCUMENTS

| | | | |
|---|---|---|---|
| DE | 195 47 085 | A1 | 6/1997 |
| DE | 20 2004 013 279 | U1 | 12/2004 |
| EP | 0 776 030 | A2 | 5/1997 |
| EP | 0 940 219 | A2 | 9/1999 |
| EP | 0 941 803 | A2 | 9/1999 |
| JP | 09-272050 | | 10/1997 |
| JP | 2008073807 | A | 4/2008 |

* cited by examiner

APPARATUS FOR DOUBLE-SIDED, GRINDING MACHINING OF FLAT WORKPIECES

CROSS-REFERENCE TO RELATED APPLICATIONS

Not applicable.

STATEMENT REGARDING FEDERALLY SPONSORED RESEARCH

Not applicable.

BACKGROUND OF THE INVENTION

The invention relates to an apparatus for the double-sided, grinding machining of flat workpieces with an upper and a lower work disk, each of which has a work surface with a grinding layer, wherein the work surfaces form a work gap amongst themselves, in which workpieces can be ground, wherein at least one of the work disks is rotatably drivable by means of a driving mechanism, and further having a device for guiding the workpieces in the work gap.

The use of double-side, surface-grinding machines for precise machining of workpieces with two plane-parallel surfaces is known. There are many corresponding machines with different designs. All conventional double-side, surface-grinding machines are similar in that they have two, normally annular work disks, the front surfaces of which are covered with an abrasive material and face each other and which form a work gap amongst themselves, through which the workpieces are guided and thereby processed simultaneously on both sides. A double-side grinding machine with planetary kinematics, as described in DE 195 47 085 A1, is just named as an example.

The machining of certain materials, for example soft steels, with such machines results in normally undesired burr formation on the workpiece edges, whereby remachining on special deburring machines is required. Many models of such machines are also known, wherein grinding burrs are normally removed with brush deburrers. For this, the workpieces are directed past rotating brushes, the bristles of which are studded with abrasive grains. A corresponding device is known for example from DE 20 2004 013 279 U1. The deburring of the workpieces with such machines represents another machining step in addition to the grinding machining, which accordingly increases the effort and cost of the machining of flat workpieces.

BRIEF SUMMARY OF THE INVENTION

Based on the explained state of the art, the object of the invention is to provide an apparatus of the initially named type, with which a double-sided, grinding machining of flat workpieces that tend to form burrs is also possible with little effort and high quality.

For an apparatus of the initially named type, the object of the invention is solved in that deburring means are arranged on at least one of the work disks and are designed to deburr the workpieces during their machining in the apparatus.

In the apparatus, the workpieces to be machined are moved by the guiding device in the work gap formed between the work surfaces of the work disks and thereby ground simultaneously on both sides by the work surfaces in that, in a known manner, at least one of the work disks is driven in a rotating manner. The work disks can be arranged coaxially for machining. However, a non-coaxial alignment of the work disks is also possible. The machining of the flat workpieces normally serves to produce plane-parallel workpiece surfaces. For example, they can be made of a metallic material, in particular a steel material. For example, the workpieces can also be semiconductor wafers or other workpieces.

In the course of the grinding, more or less prominent burrs can form on the workpiece edges depending on the workpiece material. The apparatus according to the invention thus has deburring means arranged on at least one work disk. The deburring means according to the invention can be provided in particular on both work disks. Through these deburring means, the workpieces are already deburred in the apparatus during their grinding machining or respectively the burr formation is already counteracted through the deburring means. Thus, a considerable amount of burrs cannot even form in the first place. The deburring means are thereby arranged such that the workpieces en route to their machining in the apparatus come in contact with both the work surfaces and with the deburring means. The apparatus according to the invention thus combines the functionality of a double-side, surface-grinding machine with that of a deburring machine so that the workpieces are simultaneously ground and deburred. Thus, in situ deburring takes place during machining.

According to one embodiment, the deburring means can be integrated into the work surface of the at least one work disk. The workpieces will be simultaneously deburred in the work gap during their machining in it. A particularly compact construction of the apparatus is achieved in this manner. For this, the at least one work disk can have at least one recess formed in the area of the work surface, in particular at least one groove, in which the deburring means are arranged. Corresponding recesses in the front surface bordering the work gap of the at least one work disk are thus formed for the deburring means.

Depending on the type of machining of the workpieces or respectively the embodiment of the guide device for the workpieces and thus the movement paths described by them in the course of machining in the work gap, different geometrical designs of the deburring means can be advantageous. In another embodiment, the deburring means can thus be arranged in a ring-like manner circumferentially in the work surface and/or radially in the work surface and/or in a curved manner in the work surface.

An integration of the deburring means in the work surfaces is in particular advantageous for devices with so-called planetary kinematics. According to another embodiment, the device can have at least one, in particular several, runner disks arranged in the work gap for guiding the workpieces, which receives the workpieces to be processed in recesses and can be rotated by means of a roller device, whereby workpieces received in the runner disk move along cycloid paths in the work gap. The roller device can have, in a known manner, an inner and an outer pin or toothed ring, wherein at least one of the pin or toothed rings can be rotated by means of a drive. The at least one runner disk can then accordingly have external teeth on its perimeter, with which it rolls on it during the rotation of at least one pin or toothed ring.

It is also possible to arrange the deburring means outside of the work surface on the at least one work disk. The deburring means can thereby be connected with the work disk, but do not have to be. Furthermore, it can be provided that the deburring means are arranged annularly and circumferentially on the outer perimeter of the work disk. Additionally or alternatively, it can be provided in the case of annularly designed work disks that the deburring means are arranged annularly circumferentially on the inner perimeter of the work disk. The deburring means thus run annularly along the inner and/or outer perimeter of the at least one work disk. In this embodiment, the workpieces are debarred when they are removed from the work gap or enter it and thus make their way into the action area of the deburring means. This removal or insertion of the workpieces and the corresponding contact with the deburring means can take place once or cyclically in the course of workpiece processing.

The design of the deburring means outside of the work surface is particularly suitable for devices that do not have planetary kinematics. Accordingly, in the case of the apparatus according to the invention, the device for guiding the workpieces in the work gap can also guide for the purpose of machining the workpieces out of one area outside of the work gap into the work gap and back out of it again. Such a device can for example have a rotatably driven guide disk, the rotational axis of which is arranged mainly parallel but offset to the rotational axis/axes of the work disks. The workpieces can be held by this guide disk and in the course of the rotation of the guide disk guided into the work gap, through it and out of the work gap again. They thereby come in contact with the deburring means arranged for example on the edge of the at least one work disk.

According to another especially practical embodiment, the deburring means can have deburring brushes, which protrude with their bristles over the plane of the work surface of the at least one work disk. The brushes can have individual bristle bunches, which are provided with abrasive grains for deburring. The bristle bunches are arranged behind each other along a for example annular, radial or curved progression of the deburring means. They protrude slightly beyond the plane spanned by the work surface of the respective work disk, that is in particular into the work gap. The workpieces then come in contact with the bristles during machining and are deburred in this manner. In practice, it has proven beneficial if the bristles protrude 0.1 mm to 1 mm over the work surfaces into the work gap.

According to another embodiment, the deburring means, in particular the deburring brushes, can be height-adjustable. This height adjustability can define exactly how far the deburring means can extend into the work gap. Moreover, a continuous readjustment of the position of the deburring means can be performed with the height adjustability if necessary, in order to maintain the desired projecting length even in the case of wear and tear of the deburring means. Normally, the wear of the deburring means takes place faster or slower than the wear of the grinding layers of the work disks. The height adjustment of the deburring means can for example take place through replaceable fixed or adjustable spacers, on which the deburring means, for example the deburring brushes are mounted. However, an adjustment is also conceivable by means of set screws, which can be actuated manually or by motor and permit height adjustment in this manner.

According to another embodiment, the deburring means can be driven in a rotating manner. The deburring effect is improved through rotation of the deburring means. The deburring means can thereby be driven by the same drive as the at least one work disk. But it is also conceivable to provide another separate drive than that of the work disk for the deburring means. This is conceivable in particular when the deburring means are arranged outside of the work disks and independently of them. In the case of this embodiment, the rotational speeds for the work disks and the deburring means can be selected independently of each other and opposite rotational directions can also be set for example. The flexibility is thereby increased and the deburring effect can be further optimized.

BRIEF DESCRIPTION OF THE SEVERAL VIEWS OF THE DRAWINGS

One exemplary embodiment of the invention is explained below in greater detail using figures. The drawing shows schematically in.

DETAILED DESCRIPTION OF THE INVENTION

Figure 1:
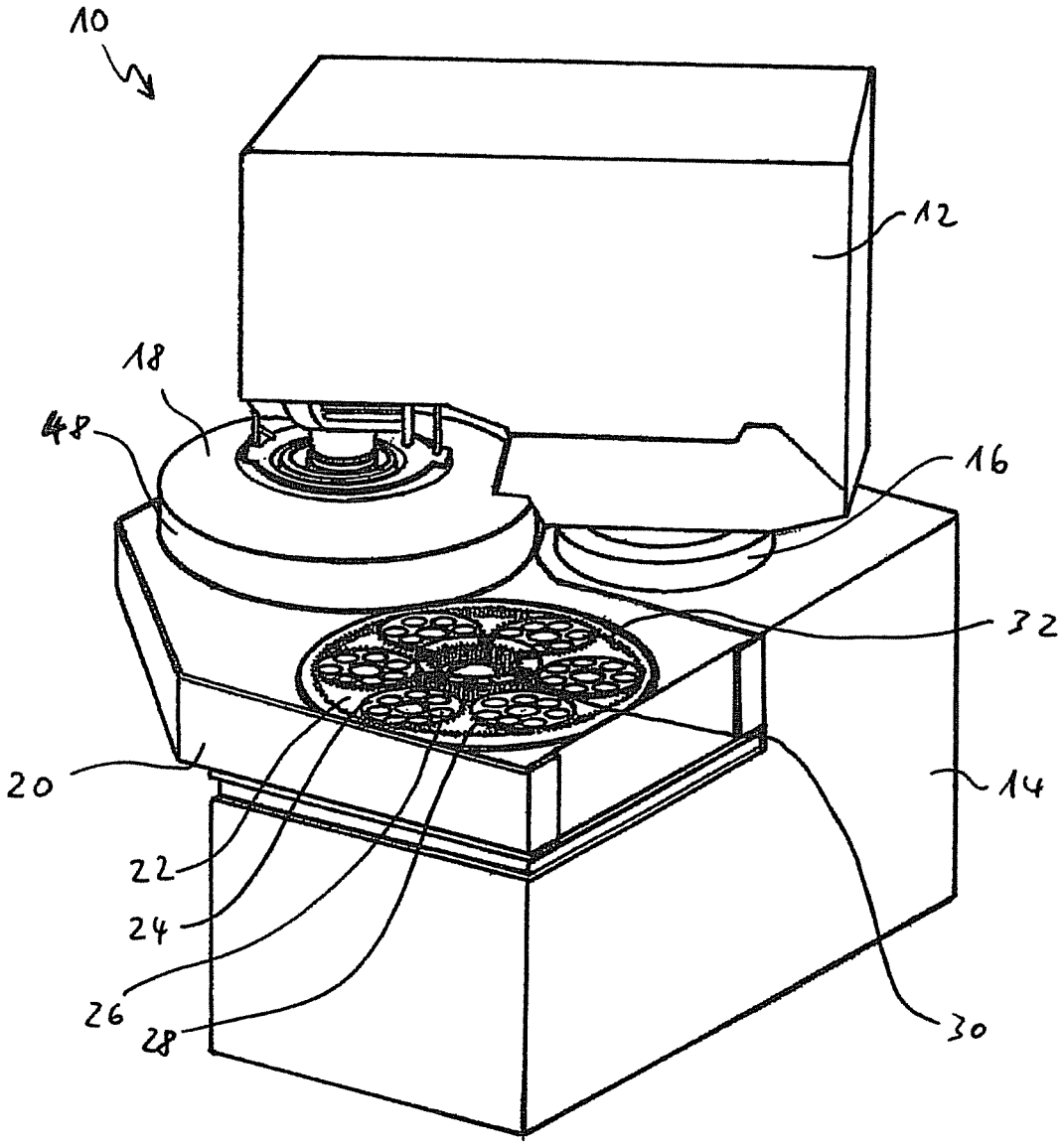
FIG. 1 the general structure of an apparatus according to the invention in a perspective view according to a first exemplary embodiment, FIG. 2 a section of an apparatus according to the invention in a perspective view according to a second exemplary embodiment, FIG. 3 a work disk of an apparatus according to the invention in a top view according to a first exemplary embodiment, FIG. 4 the work disk shown in FIG. 3 in cross-section, FIG. 5 a work disk of an apparatus according to the invention in a top view according to a second exemplary embodiment, FIG. 6 the work disk shown in FIG. 5 in cross-section, and FIG. 7 a work disk of an apparatus according to the invention in a top view according to a third exemplary embodiment.

While this invention may be embodied in many different forms, there are described in detail herein a specific preferred embodiment of the invention. This description is an exemplification of the principles of the invention and is not intended to limit the invention to the particular embodiment illustrated If not specified otherwise, the same reference numbers are used for the same objects in the figures. FIG. 1 shows the general structure of an apparatus according to the invention for double-sided machining of flat workpieces. The apparatus shown in the example in FIG. 1 is a double-side grinding machine 10 with planetary kinematics. The apparatus 10 has an upper pivot arm 12, which can be pivoted around a vertical axis via a pivot device 16 mounted on a bottom base 14. An annular upper work disk 18 is carried on the pivot arm 12. The upper work disk 18 is rotatably drivable via a drive motor not shown in greater detail in FIG. 1. On the bottom side not shown in FIG. 1, the work disk 18 has a work surface, which is provided in the shown example with a grinding layer. The base 14 has a carrier section 20, which has an annular lower work disk 22. It also has a work surface on its top side. The lower work disk 22 is also rotatably drivable via a drive motor (not shown), in particular opposite to the upper work disk 18. Several runner disks 24 are shown on the lower work disk 22, each of which have recesses 26 for workpieces to be machined. The runner disks 24 each have external teeth 28, with which they engage with an inner pin rim 30 and an outer pin rim 32 of the apparatus. In this manner, a roller device is formed, wherein the runner disks 24 can also be rotated during a rotation of the lower work disk 22 for example via the inner pin rim 30. The workpieces arranged in the recesses of the runner disks 24 then move along cycloid paths.

For machining, the workpieces to be ground are inserted into the recesses 26 of the runner disks 24. The two work disks 18, 22 are aligned with each other coaxially by pivoting the pivot arm 12. They then form amongst themselves a work gap, in which the runner disks 24 are arranged with the workpieces held by them. In the case of at least one rotating upper or lower work disk 18, 22, the upper work disk 18 is then pressed for example onto the workpieces by means of high-precision load system. A pressing force is then exerted on the workpieces to be processed from both the upper and the lower work disk 18, 22 and they are simultaneously ground on both sides. The structure and the function of this type of double-side machining machine 10 are generally known to a person skilled in the art.

Figure 2:
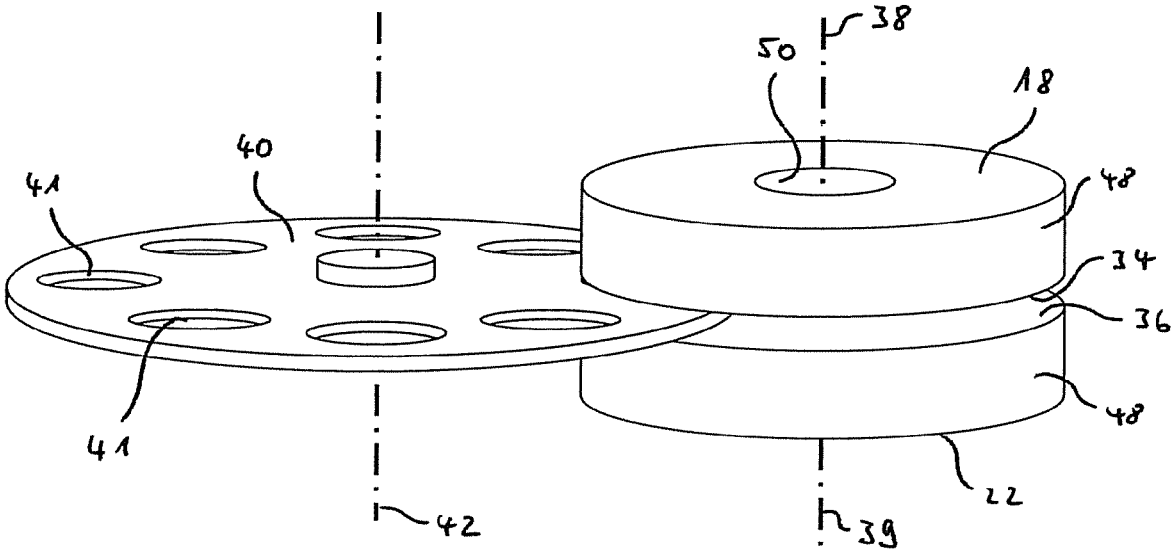

FIG. 2 shows a part of the apparatus according to the invention according to a second exemplary embodiment in a perspective view. The annular upper work disk 18 and the also annular lower work disk 22 can be seen. The upper work disk 18 has, as in the example shown in FIG. 1, a work surface 34 with a grinding layer. Accordingly, the lower work disk 22 also has a work surface 36 with a grinding layer. The work surfaces 34, 36 amongst each other border the work gap. In the example shown in FIG. 2, the upper and lower work disks 18, 22 are aligned with each other mainly coaxially and rotate around rotational axes 38. 39. In contrast to the apparatus shown in FIG. 1, the apparatus in FIG. 2 has no planetary kinematics. Rather, the device for guiding the workpieces in the work gap according to FIG. 2 also has an annular guide disk 40, in which workpieces to be machined (not shown) are held in recesses 41. The guide disk 40 is rotatably drivable. Its rotational axis 42 runs mainly parallel to the rotational axis 38 of the work disks 18, 22, but offset to it. In particular, the rotational axes 38, 39 of the work disks 18, 22 can be slightly tipped against each other, in order to enable the insertion of the workpieces in the work gap. Through a rotation of the guide disk 40, the workpieces held in the recesses 41 (not shown in FIG. 2) are guided through the work gap formed between the rotating work disks 18, 22 and accordingly machined in the work gap on two sides in a grinding manner.

The structure and the function of this type of double-side machining machine 10 are generally known to a person skilled in the art. Of course, the work disks can also be arranged non-coaxially with respect to each other, for example mainly parallel, but have rotational axes arranged offset with respect to each other. Such machines are also generally known to a person skilled in the art.

Figure 3:
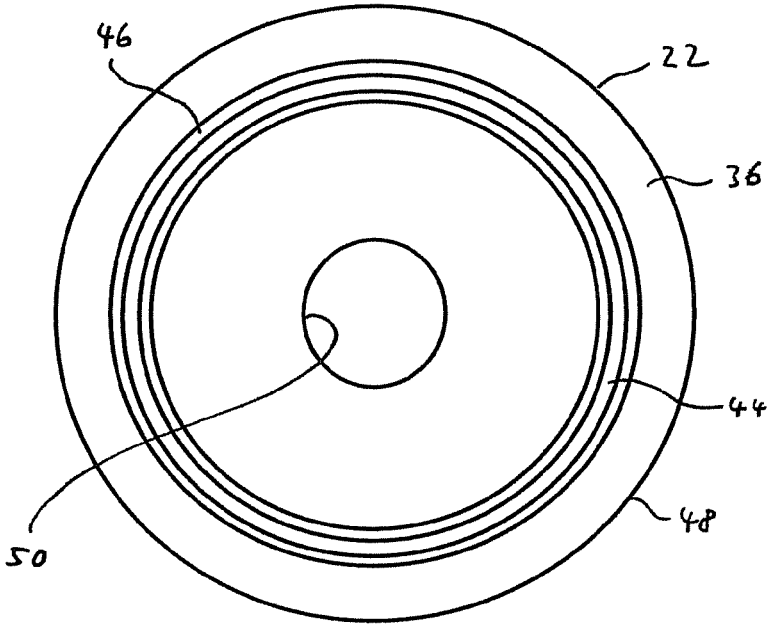
Figure 4:
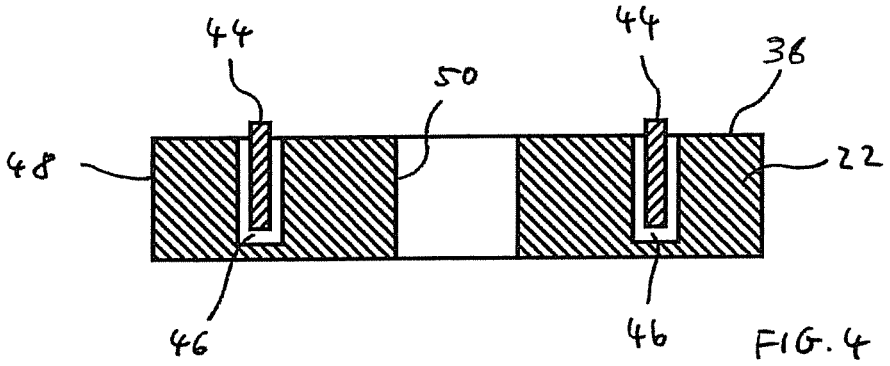

FIGS. 3 and 4 show an example of an annular lower work disk 22 that can be used in the apparatuses shown in FIG. 1 and FIG. 2. In the case of the work disk 22 shown in FIGS. 3 and 4, deburring means 44, deburring brushes 44 in the example shown, are integrated into the work surface 36. For this, the work disk 22 has an annual, circumferential groove 46 in the area of its work surface 36, in which the deburring brushes 44 are arranged. They thus also progress circumferentially in the work surface 36. For example, the deburring brushes 44 have several bristle bunches (not shown in greater detail), which are arranged behind each other along the progression of the deburring brushes 44. As can be seen in the cross-section in FIG. 4, the deburring brushes 44 with their bristles project over the plane of the work surface 36 of the work disk 22. When used in the apparatuses from FIG. 1 or FIG. 2, the workpieces thus come in contact with the projecting deburring brushes 44 during the course of their machining in the apparatus and are simultaneously deburred in this manner during their machining. The integration of the deburring means 44 shown in FIGS. 3 and 4 into the work surface 36 of the work disk 22 is suited in particular for use in an apparatus with planetary kinematics, as shown for example in FIG. 1.

Figure 5:
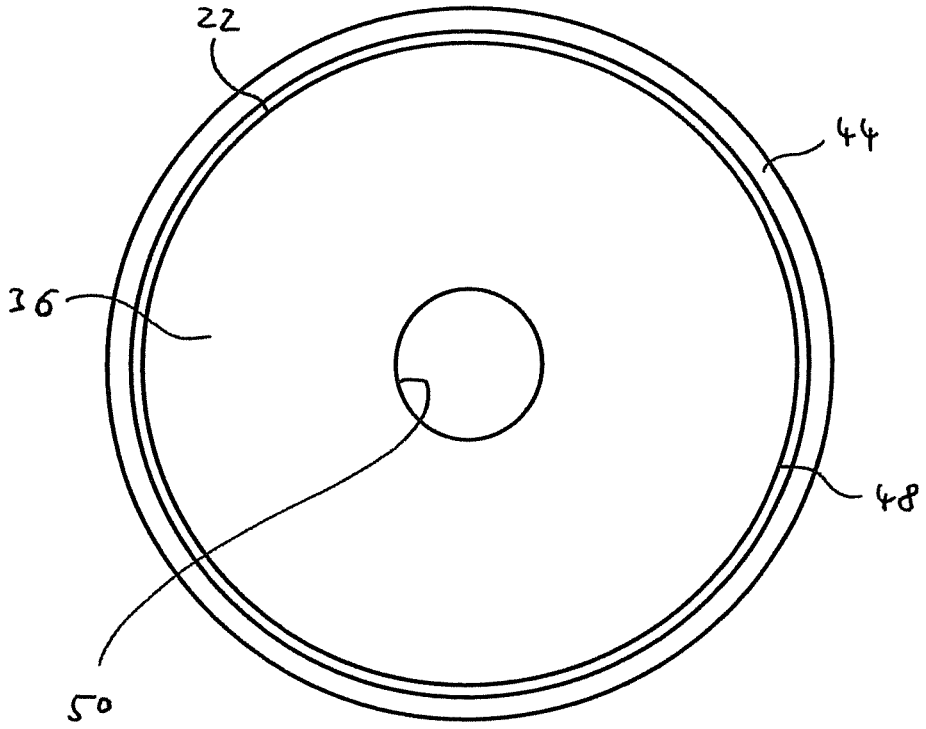
Figure 6:
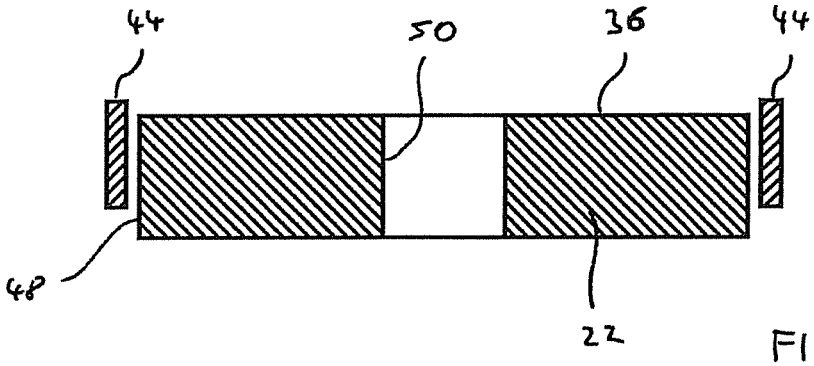

FIGS. 5 and 6 show a work disk 22 in accordance with another exemplary embodiment. In contrast to the example shown in FIGS. 3 and 4, the deburring brushes 44 in this work disk 22 are arranged outside of the work surface 36 on the work disk 22. The deburring brushes 44 are thereby arranged annularly circumferentially on the outer perimeter 48 of the work disk 22 and fastened in a manner not shown in greater detail. The fastening can be provided on the work disk 22 or otherwise independently of the work disk 22. In the course of their rotation with the guide disk 40, the workpieces held in the guide disk 40 come into the action area of the deburring brushes 44 as they enter and exit the work gap formed between the work surfaces 34, 36 and are correspondingly deburred. Although this is not shown in FIGS. 5 and 6, additional or alternative deburring means 44 can naturally also be arranged annularly circumferentially on the inner perimeter 50 of the work disk 22. The embodiment shown in FIGS. 5 and 6 is suitable in particular for use in an apparatus as shown schematically in FIG. 2.

Figure 7:
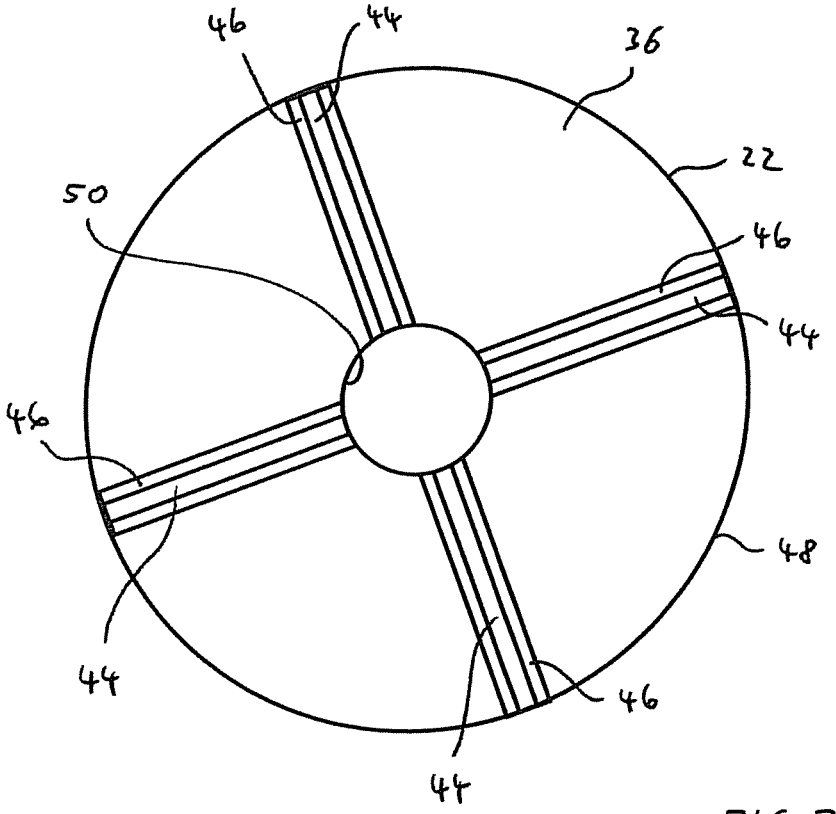

Depending on the design of the guide device for the workpieces and thus the paths described by them in the course of the machining in the work gap, further geometrical designs of the deburring means 44 can be advantageous. In this regard, a top view of the work disk 22 with deburring brushes 44, which progress radially in the work surface 36 and are integrated into the work surface 36, is shown in FIG. 7 only as an example. Naturally, the deburring means 44 could also progress for example in a curved manner in the work surface 36 guided by corresponding recesses 46 or describe another progression.

Please note that even though FIGS. 3 through 7 show examples of a lower work disk 22, the upper work disk 18 can naturally be provided with deburring means according to the invention alternatively or additionally to the lower work disk 22.

The deburring brushes 44 shown in the figures are height-adjustable so that a sufficient projecting length of the deburring brushes 44 beyond the work surface plane into the work gap is always ensured even during the wear of the brushes 44. In the example shown, this projecting length is set between 0.1 and 1 mm This completes the description of the preferred and alternate embodiments of the invention. Those skilled in the art may recognize other equivalents to the specific embodiment described herein which equivalents are intended to be encompassed by the claims attached hereto.

The invention claimed is:

1. Apparatus for the double-sided, grinding machining of flat work-pieces with an upper and a lower work disk (18, 22), each of which has a work surface (34, 36) with a grinding layer, wherein the work surfaces (34, 36) form a work gap amongst themselves, in which work-pieces can be ground, wherein at least one of the work disks (18, 22) is rotatably drivable by means of a driving mechanism, and further having a device for guiding the work-pieces in the work gap, said at least one work disk defining at least one recess extending below the grinding layer of the work surface, wherein de-burring brushes (44) are arranged on at least one of the work disks (18, 22) in said recess, which are designed to de-burr the work-pieces during their machining in the apparatus.

2. The apparatus according to claim 1, wherein the recess (46) formed in the area of the work surface (34, 36), is a groove (46), in which the de-burring brushes (44) are arranged.

3. The apparatus according to claim 2, wherein the de-burring brushes (44) are arranged annularly in the work surface (34, 36).

4. The apparatus of claim 1 wherein the device for guiding the work-pieces has at least one runner disk (24) arranged in the work gap, which receives the work-pieces to be machined in recesses (26) and can be rotated by of a roller device, whereby received work-pieces in the runner disk (24) move along cycloid paths.

5. The apparatus of claim 1, wherein the de-burring brushes (44) are arranged outside the work surface (34, 36) on the at least one work disk (18, 22).

6. The apparatus according to claim 5, wherein the de-burring brushes (44) are arranged circumferentially on the outer perimeter (48) of the work disk (18, 22).

7. The apparatus according to claim 5, wherein the at least one work disk (18, 22) is circular and that the de-burring brushes (44) are arranged circumferentially on an inner perimeter (50) of the work disk (18, 22).

8. The apparatus of claim 1, wherein the de-burring brushes (44) have bristles which project over the plane of the work surface (34, 36) of the at least one work disk (18, 22).

9. The apparatus according to claim 8, wherein the de-burring brushes (44) are height-adjustable.

10. The apparatus of claim 1, wherein the de-burring brushes (44) can be driven in a rotating manner.

11. The apparatus according to claim 10, wherein the de-burring brushes (44) can be driven in a rotating manner independently of the at least one work disk (18, 22).

12. The apparatus according to claim 2, wherein the de-burring brushes (44) are arranged from the outer edge toward a central axis of the work surface.

* * * * *